US007607282B2

(12) United States Patent
Mougin

(10) Patent No.: US 7,607,282 B2
(45) Date of Patent: Oct. 27, 2009

(54) MACHINE FOR AUTOMATED PACKAGING OF PRODUCTS(S) IN A CARDBOARD BOX

(75) Inventor: Didier Mougin, Octeville sur Mer (FR)

(73) Assignee: Sidel Participations, Octeville-sur-Mer (FR)

( * ) Notice: Subject to any disclaimer, the term of this patent is extended or adjusted under 35 U.S.C. 154(b) by 56 days.

(21) Appl. No.: 11/817,584

(22) PCT Filed: Jan. 10, 2006

(86) PCT No.: PCT/EP2006/050125

§ 371 (c)(1),
(2), (4) Date: Oct. 15, 2007

(87) PCT Pub. No.: WO2006/092342

PCT Pub. Date: Sep. 8, 2006

(65) Prior Publication Data

US 2008/0155945 A1 Jul. 3, 2008

(30) Foreign Application Priority Data

Mar. 3, 2005 (FR) ..... 05 50573

(51) Int. Cl.
*B65B 43/46* (2006.01)

(52) U.S. Cl. ..... 53/564; 53/468; 53/267; 53/250

(58) Field of Classification Search ..... 53/452, 53/456–458, 468, 564, 566, 579, 249–250, 53/267

See application file for complete search history.

(56) References Cited

U.S. PATENT DOCUMENTS 1,794,010 A 2/1931 Gangler
1,873,059 A * 8/1932 Smith et al. ..... 53/73
4,476,973 A 10/1984 Kessler et al.
4,603,770 A 8/1986 Hartness et al.
4,642,975 A * 2/1987 Langen et al. ..... 53/564
5,187,919 A * 2/1993 Guardiola ..... 53/443
5,454,215 A * 10/1995 Martelli ..... 53/564

(Continued)

FOREIGN PATENT DOCUMENTS

EP 0761535 3/1997

*Primary Examiner*—Christopher Harmon
(74) *Attorney, Agent, or Firm*—Young & Thompson

(57) ABSTRACT

The present invention relates to a machine (10) for packaging a product or products (28) in a cardboard box (12), which comprises boxing means arranged along a longitudinal packaging line (16) comprising a first station (A) for making-up a box blank (14) and which comprises a conveying device (30) for transfer, in an outbound path, the box (12A) made up at the station (A) to a second, filling, station (B) for boxing the products (28) then on to a third station (C) where the box (12C) is sealed before it is discharged from the machine (10), characterized in that the conveyor device (30) comprises a carriage (32) which is mounted to be able to move longitudinally between an extreme upstream position and an extreme downstream position, and which bears box transfer means (34) comprising at least a first gripper (36) for transferring a made-up box (12A) from the first station (A) to the second station (B) and a second gripper (38) for simultaneously transferring another, filled, box (12B) from the second station (B) to the third station (C).

21 Claims, 5 Drawing Sheets

U.S. PATENT DOCUMENTS 5,517,798 A * 5/1996 Klopfenstein ..... 53/249
5,727,365 A 3/1998 Lashyro et al.
7,434,376 B2 * 10/2008 Monti ..... 53/564

* cited by examiner 12A
12B
12C
-1-
-2-
-3-
-4-
L
V
T
H
P
F

MACHINE FOR AUTOMATED PACKAGING OF PRODUCTS(S) IN A CARDBOARD BOX

FIELD OF THE INVENTION

The invention relates to a machine for the automated packaging of a product or products in a cardboard box.

BACKGROUND OF THE INVENTION

The present invention relates more particularly to a machine for packaging a product or products into a cardboard box in a boxing cycle comprising at least three successive operations for making up, filling and sealing the box, the machine comprising boxing means which are arranged along a longitudinal packaging line of the machine comprising, from the upstream end downstream, a first, making-up, station which receives a succession, at a given rate, of box blanks intended to be at least partially made up and comprising a conveyor device for successively transferring in the downstream direction in an outbound path the box which has thus been made up toward a second, filling, station at which the products are packed into the box by associated loading means able to deposit the products that are to be packaged in the box, and then on to a third, box-sealing, station at which the box is sealed before it is discharged from the machine.

Numerous packaging machines of this type for packing or boxing products, particularly prepackaged products such as tins, bottles, bags, etc., that is to say, in general, any kind of packaged goods, particularly with a view to protecting them and making them easier to transport, for example to dispatch from a production site to a sales outlet, are known.

The various types of packaging machine are conventionally configured according to the type of cardboard box used for boxing or overwrapping the products.

The term "overwrapping" defines the operation of reinforcing or protecting a group or batch(es) of prepackaged products.

Thus, a broad distinction is drawn between machines of the "boxing" type using boxes with flaps, known as "American boxes" and machines of the "overwrapper" type which use boxes of the "wrap-around" type.

Whatever the type of packaging machine, the boxing cycle generally involves at least the three operations, that is to say making up the box, filling it and sealing it. These operations are performed in succession along the packaging line thanks to a conveying device that conveys the boxes between the various stations.

For example, a conveying device comprising two chains mounted in parallel, each having dogs arranged in such a way as to restrain the bottom of the box near its four corners so that the boxes can be transferred to each of the stations in the packaging line of the machine, is known.

A lateral part of the bottom of each box is therefore in contact with a longitudinal portion of each chain lying between two successive dogs. The dogs are mounted such that they are secured to each chain and extend vertically above the chains to restrain the box longitudinally in the direction of travel, so that items can be boxed.

The endless chains are rotated by drive means, such as a motor, which are connected to two transverse axles, fitted with sprockets, arranged at each of the upstream and downstream ends of the packaging line.

However, such chain-type conveyor devices are not entirely satisfactory.

The problem is that at high operating rates, chain-type conveyor devices are generally unable to position the box blanks or boxes accurately between the dogs, and this may lead to operational incidents, particularly during filling, as a result of boxes being incorrectly restrained or positioned.

In addition, it has been found that the articulated links that make up each chain are sensitive to the various types of dirt and contaminant to which the conveyor device is exposed.

As a result, such chain-type conveyor devices are unsatisfactory in certain applications, such as in the field of cosmetic products for example, especially where such packaging machines are being required to exhibit improved reliability, improved productivity, particularly in the form of an increase in throughput, and operational flexibility so that they can, to advantage, cope with rapid changes in cardboard box format.

SUMMARY OF THE INVENTION

It is therefore an object of the invention to overcome the disadvantages of the prior art and to propose, in particular, a machine that is more reliable and can operate at a higher rate.

To these ends, the invention proposes a packaging machine of the type described previously, characterized in that the conveyor device comprises a carriage which is mounted to be able to move longitudinally between an extreme upstream position and an extreme downstream position, and which bears box transfer means comprising at least a first gripper for transferring a made-up box from the first station to the second station and a second gripper for simultaneously transferring another, filled, box from the second station to the third station.

According to other features of the invention:

- each of the grippers comprises an upstream restraining means and a downstream restraining means which are mounted such that they can move between:
  - an active position in which the restraining means collaborate with part of the corresponding box in order simultaneously to transfer each box from one given station to the next station, and
  - an inactive position in which, having transferred said boxes, the restraining means are retracted so as to allow the carriage to reposition itself in its upstream initial position, in a return path;
- the conveying device comprises discharge means for discharging the sealed box from the sealing station C of the machine, which means are mounted such that they can move between an active position and an inactive position in a way that is synchronized with the movement of the upstream restraining means;
- in the active position, the restraining means of each gripper or discharge means collaborate with at least part of the transverse faces which are adjacent to the horizontal bottom of the box such that, between two successive stations, the bottom of each box slides along a guide path;
- the guide path consists of the upper horizontal bearing face of two longitudinal rails of the packaging line between which the restraining means of the first and second grippers and/or the discharge means are positioned;
- the restraining means of each gripper and/or the discharge means are mounted such that they can pivot about a transverse axis orthogonal to the longitudinal rails respectively between the active position in which the upstream and downstream restraining means and/or the discharge means extend vertically above the upper horizontal faces of the rails so as to collaborate with the box, and the inactive position in which the upstream and downstream restraining means and/or the discharge means are retracted below the upper horizontal face of the rails during the return path of the carriage;

the machine comprises immobilizing means capable of temporarily holding each box in a longitudinal position at a given station when the restraining means and/or the discharge means are retracted into their inactive position;

the temporary-immobilizing means consist of fingers which, arranged in each of the longitudinal rails, are mounted such that they can move between a working position in which the fingers project above the plane of the upper horizontal face of the rails so as to immobilize the box and a position of rest in which the fingers are retracted below the upper horizontal face so as not to interfere with the box while it is being transferred to the next station;

the carriage comprises a vertical first flange supporting the upstream restraining means and/or the discharge means, and a vertical second flange supporting the downstream restraining means, and the first and second flanges are mounted such that they can move one relative to the other in the longitudinal direction so as to allow the longitudinal distance between the upstream and downstream restraining means and/or between the discharge means and the immobilizing means to be adjusted to suit the dimensions of the cardboard box, particularly the length of its bottom;

each restraining means of a gripper and/or the discharge means consists of a pair of arms of which at least one is mounted such that it can move transversely so as to allow the transverse separation between each of the arms to be adjusted to suit the dimensions of the cardboard box, particularly the width P of its bottom;

the carriage is arranged transversely on the outside of the packaging line so as to free up the space situated vertically under the packaging line to facilitate access to this part of the machine, particularly with a view to adjusting the transfer means or performing maintenance or cleaning operations.

BRIEF DESCRIPTION OF THE DRAWINGS

Other features and advantages of the invention will become apparent from reading the detailed description which follows, for an understanding of which reference will be made to the attached figures among which.

DETAILED DESCRIPTION OF EMBODIMENTS

Figure 1:
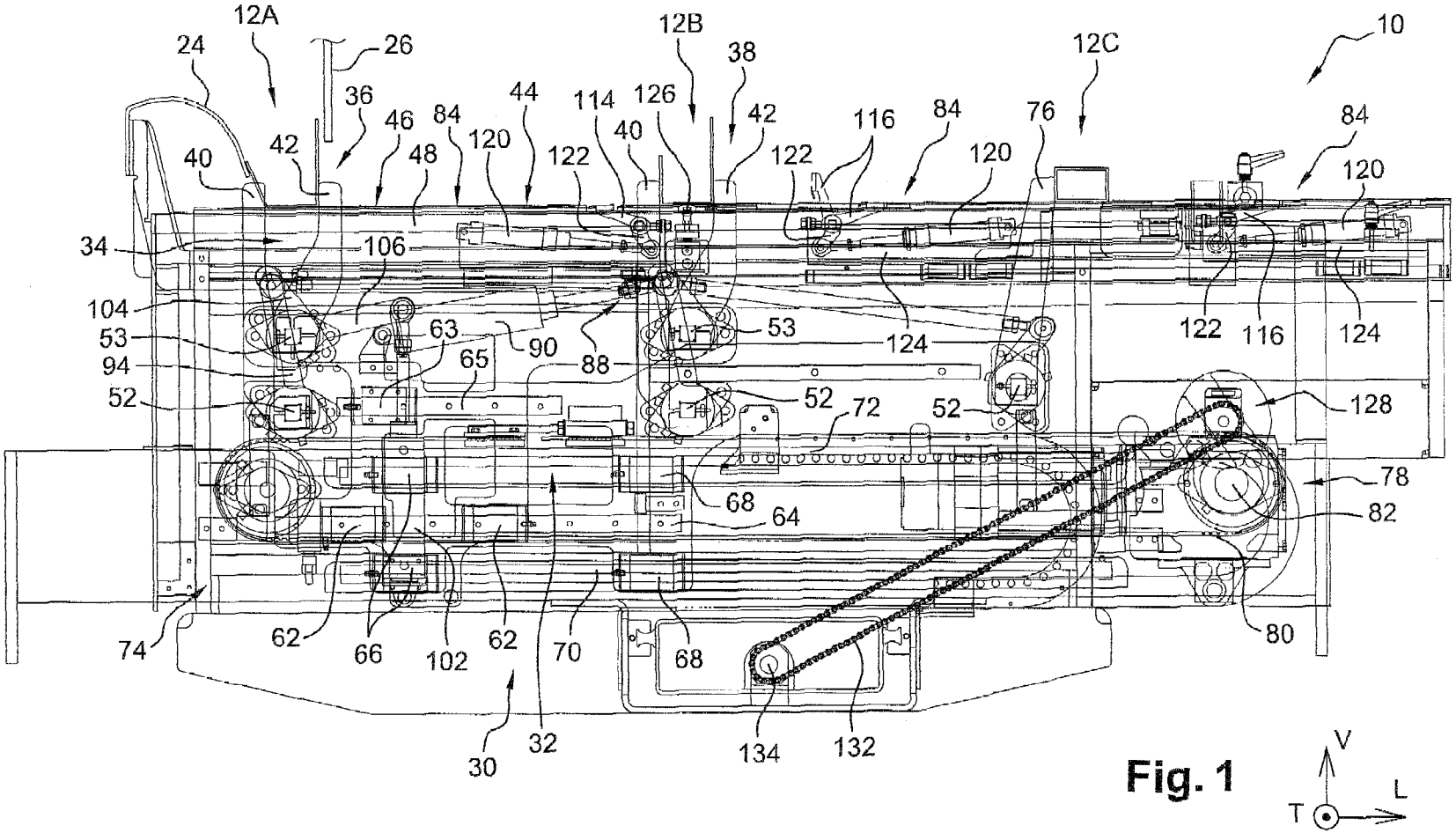
FIG. 1 is a side view from the right of a packaging machine for packing products into a box comprising a carriage-type conveying device according to the invention.

The description and the claims nonlimitingly employ terms such as "upstream" and "downstream", "upper" and "lower", "external" and "internal" and the orientations "longitudinal", "vertical" and "transverse" with reference to the trihedral frame of reference (L, V, T) indicated on the figures and the definitions provided in the description.

In addition, elements of the invention that are identical, similar or analogous will be denoted by the same reference numerals.

Figure 2:
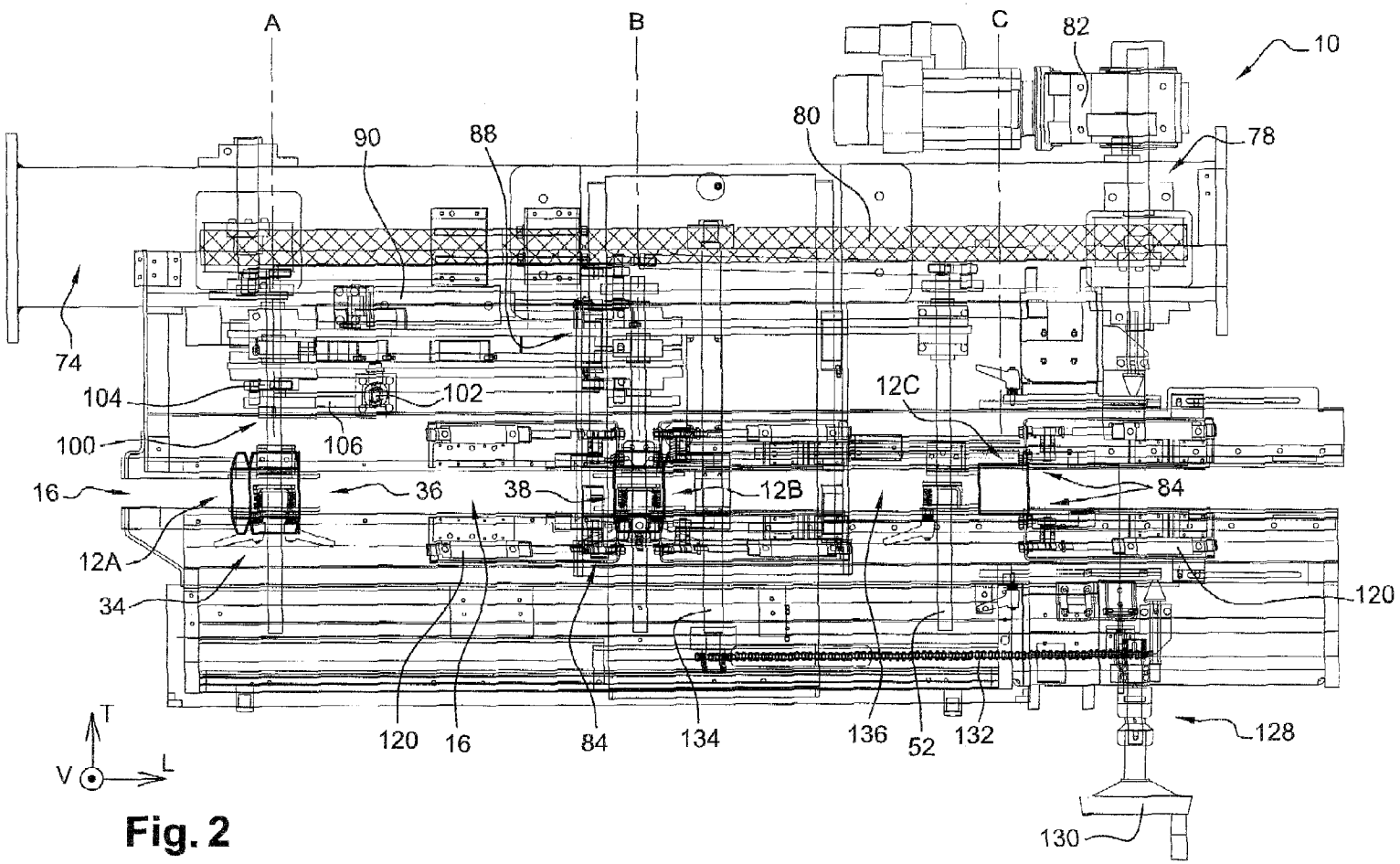
FIGS. 2 and 3 are a view from above and an end-on view from the upstream end, respectively, of the machine according to FIG. 1.
Figure 3:
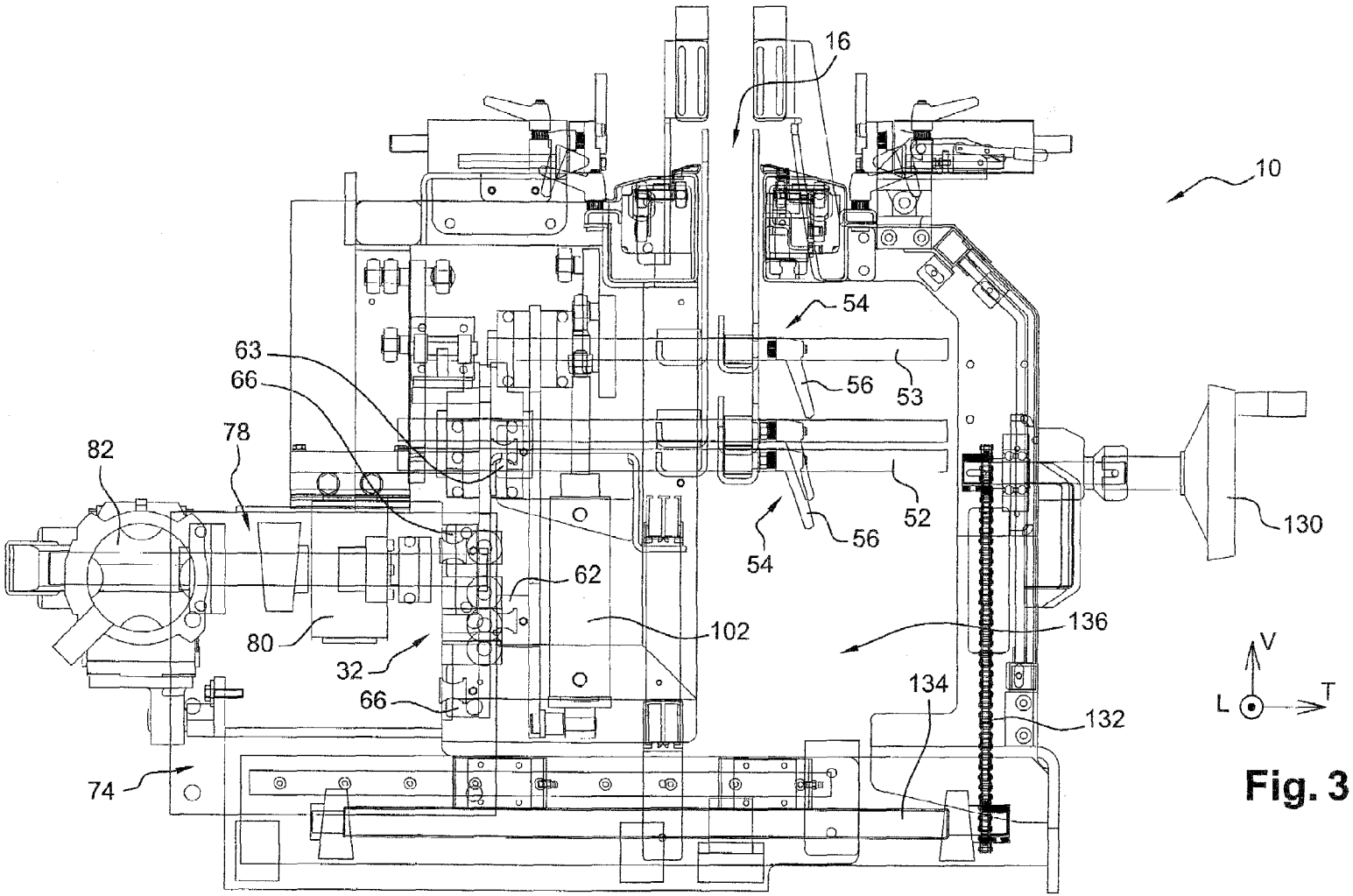

FIGS. 1 to 3 depict a machine 10 for the automated packaging of a product or products in a cardboard box 12, illustrating one embodiment of the invention.

Figures 4, 5A, 5B, 5C, 5D, 5E, 5F:
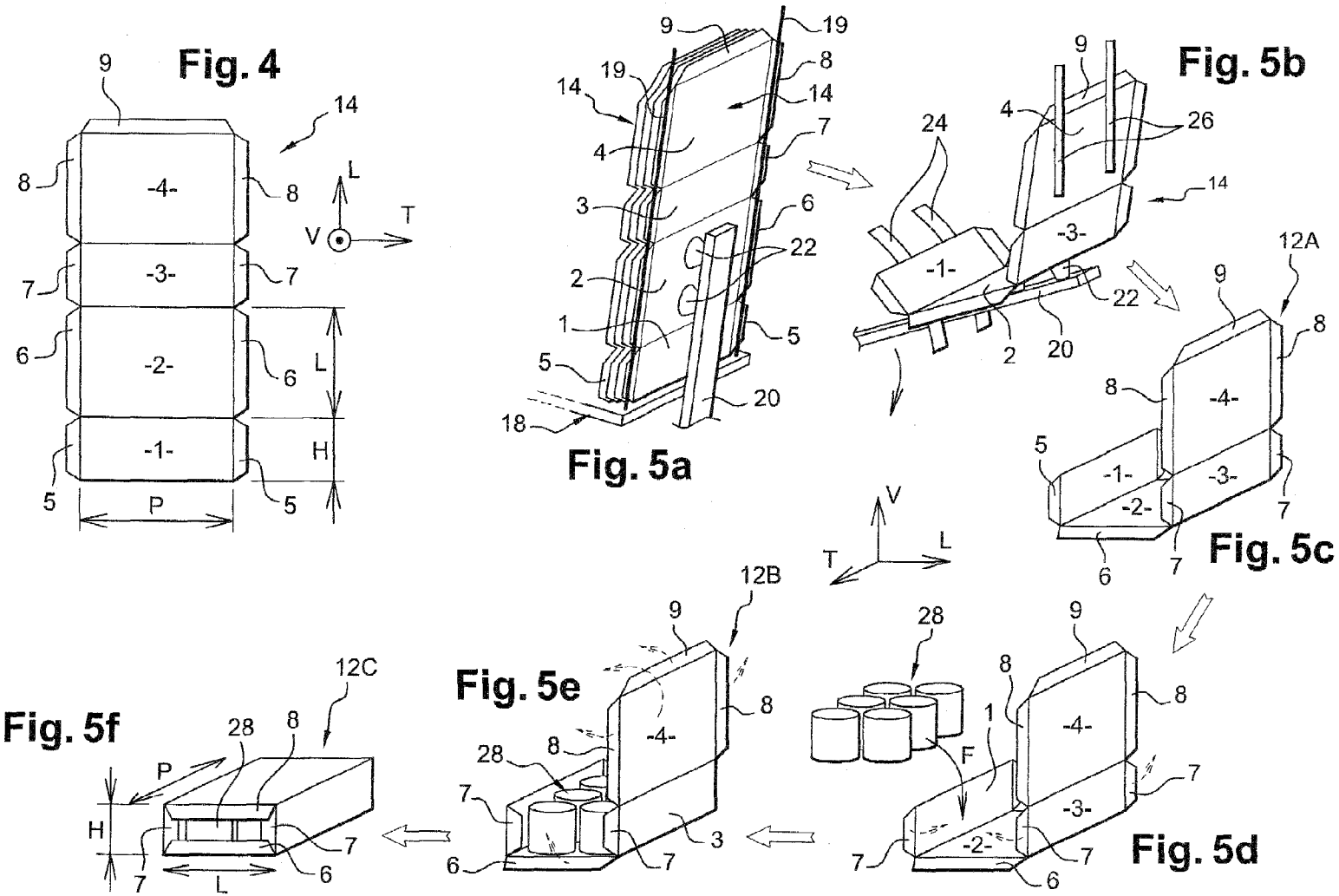
FIG. 4 is a view from above of one example of a flat box blank intended, once it has been made up, to form a box of the "wrap-around" type.
FIGS. 5*a* to 5*f* are schematic perspective views illustrating the main steps in a boxing cycle comprising operations of making up the blank, filling the box and sealing it.

The machine 10 here is a machine of the "overwrapping" type, that is to say a machine in which the boxes containing the packaged products, as illustrated in FIGS. 4 and 5, are obtained by successively making up a box blank 14 of the "wrap" or "wrap-around" type which basically means that it is wrapped around the product.

As a preference, the packaging of products by the machine 10 is performed according to a boxing or box-packing cycle which, in the main, involves at least the three successive operations of making up, filling and sealing the box 12.

These boxing operations are performed at distinct workstations denoted, by convention, by the letters A, B and C, and so in order to make a distinction between the boxes, each box 12 will hereinafter be identified by the letter corresponding to the station at which it is located, namely 12A in the case of the made-up box, 12B in the case of the filled box, and 12C in the case of the sealed box, respectively.

Thus, the machine 10 comprises conventional boxing means which are arranged along a longitudinal packaging line 16 of the machine, that is to say arranged in the upstream to downstream direction with respect to the direction in which the boxes 12 travel during the cycle, and which here are positioned in three successive workstations A, B and C, as illustrated in FIGS. 1 to 3.

In the known way, the machine 10 comprises, upstream of the first station of the packaging line 16, means which have not been depicted in FIGS. 1 to 3, such as means for storing box blanks 14 associated with means for carrying each box blank 14, at a determined rate to the first station A at which the box blank 14 is received in order to be at least partially made up.

For ease of understanding, FIG. 4 depicts an example of a box blank 14 of the "wrap" type and FIGS. 5*a* to 5*f* depict the various conversion steps performed in succession along the packaging line 16 of the machine 10 according to the cycle, that is to say from the making-up of the box blank 14 to the final sealing of the wrap-type box 12 containing the products.

Before it is made up, the box blank 14 of the wrap-type box 12 is flat and usually made of corrugated cardboard. The box blanks 14 are therefore advantageously able to be stacked flat, making them easier to transport, handle or even to store.

Of course, the dimensions of the box blank 14 that will become the box 12 are determined according to the dimensions of the products that are to be packaged.

The box 12 is a right-angled parallelepiped of which, by convention, the height (H), length (L) and depth (P) here correspond respectively to the vertical, longitudinal and transverse dimensions according to the trihedral frame of reference L, V, T in FIGS. 4 and 5.

The box blank 14 of FIG. 4 mainly comprises four faces, here of rectangular shape, referenced 1 to 4 and provided respectively and laterally with at least two flaps referenced 5 to 8 in which each flap in a pair of flaps lies facing the other.

As can be better seen in FIGS. 5*a* to 5*f*, the faces 1 to 4 will, after the various making-up operations, respectively form, on the one hand, two of the four faces 1, 3 of the box and, on the other hand, the bottom 2 and the lid 4 of the box 12.

Thus, the vertical faces 1 and 3 here correspond to the transverse faces of the box 12 while the lateral faces are each formed by assembling, particularly by adhesive bonding, four lateral flaps referenced 5, 6, 7 and 8 borne respectively by the faces 1, 2, 3 and 4.

The transverse flap 9 here is secured to the free transverse edge of the lid 4 and is intended to be folded down against the external surface or, as an alternative, the internal surface, of the lateral face 1 then secured to the latter during the operation of sealing the filled box 12B.

By convention, a face or surface is said to be "internal" when it faces toward the inside of the volume of the box 12 intended to contain the products and is said to be "external" when the opposite is the case.

As an alternative, the flap 9 is secured to the free transverse edge of the transverse face 1 of the box blank 14.

The various successive operations in the boxing cycle as performed by the packaging machine 10 and illustrated in FIGS. 5*a* to 5*f* will now be described.

As a preference, the machine 10 comprises a storage magazine 18 comprising a stack of box blanks 14 with which there is associated a transfer arm 20 which forms the extraction means intended to carry a box blank 14 from the magazine 18 to the first, making-up, station A.

Advantageously, the storage magazine 18 is automatically fed with box blanks 14 by box blank feed means.

The transfer arm 20, illustrated in FIG. 5*a*, is mounted such that it can move at one, the lower one, of its ends, about a transverse axis (not depicted) between, respectively, a raised, extraction, position in which it runs more or less vertically and a lowered, making-up, position in which it runs more or less horizontally.

At the other, the top one, of its ends, the transfer arm 20 comprises gripper means, such as suction cups 22 for gripping the box blank 14, these means here being of the pneumatic type but which could, as an alternative, be of a mechanical type, such as an array comprising a number of suction cups 22 which are associated with a suction device (not depicted) that can be selectively controlled.

As illustrated by FIGS. 5*a* to 5*c*, when the transfer arm 20 is initially in its raised, extraction, position, the suction cups 22 collaborate with the proximal box blank 14, exerting a downward suction force, in this instance, on the bottom 2 of the blank.

The arm 20 causes the proximal box blank 14 to be extracted from the magazine 18 when, made to rotate, it pivots about its axis of rotation into the lowered position.

The magazine 18 comprises retaining means for retaining the box blanks 14, these means being fixed or movable and, for example, here consisting of vertical retaining bars 19 positioned near the flaps 5 to 8 in such a way that the flaps 5 to 8 become effaced with respect to the retaining bars 19 by bending so as to allow the proximal blank 14 to be extracted from the magazine 18.

FIG. 5*b* more particularly illustrates the arm 20 in an intermediate position during its downward movement from the raised position to the lowered position. In this movement, the blank 14 collaborates with guide means 24, 26 which cause the faces of the box blank 14 adjacent to the bottom 2 to bend into a more or less vertical position.

As a preference, the guide means 24, 26 comprise, on the one hand, two bowed hoops 24 which, upstream, collaborate with the external surface of the transverse face 1 to bring about a first bending about its transverse edge in common with the bottom 2 and, on the other hand, guide rods 22 which, downstream, collaborate with the external surface of the opposite face 3 and of the lid 4 to cause a second bending about the opposite transverse edge, that is to say the edge common to the bottom and to the face 3.

This first operation of making-up by bending has the main objective of forming the horizontal bottom 2 of the box 12 onto which the products for packaging will subsequently be deposited.

However, the bottom 2 does not necessarily constitute the subsequent bottom of the sealed box 12C, which bottom is determined by the actual orientation of the packaged products, which may differ from the orientation adopted for filling.

FIG. 5*c* illustrates, once the box blank 14 has been at least partially made up, the wrap-type box 12 as it is received at the first, making-up, station A of the packaging line 16 of the machine 10.

The suction device (not depicted) is made to release its suction effect when the transfer arm 20 reaches its lowered position so the suction cups 22 then stop collaborating with the underside of the bottom 2.

From the first, making-up, station A, the box 12A thus made up can then be transferred, successively in the downstream direction, by a conveying device 30 according to the invention, to a second, filling, station B where, as illustrated in FIG. 5*d*, products 28 for packaging are deposited on the bottom 2 of the filled box 12B and then on to a third, sealing, station C illustrated in FIG. 5*f*, before the sealed box 12C is discharged from the machine 10.

While the made-up box 12A is being transferred to the filling station B, the arm 20, free again, is then moved in the opposite direction namely into its raised extraction position so that it can bring a new box blank 14 from the magazine 18 to the first station A.

Advantageously, the arm 20 comprises a telescopic body so that it can leave its lowered position in a motion comprising a first longitudinal translational movement in the upstream direction and then, when there is no longer any risk of the upper part that bears the suckers 22 interfering with the bottom 2 of the box 12A, a second vertical rotational movement into its raised extraction position, the arm 20 being made to return to its initial length before it reaches this position.

In the known way, the machine 10 comprises, laterally on each side of the packaging line 16, on the one hand, means (not depicted) for holding and/or positioning the various flaps 5 to 9 of the blank 14 which, positioned longitudinally along the packaging line 16, come into action during the successive boxing operations and, on the other hand, means (not depicted) for coating the flaps 5 to 9 with adhesive.

The adhesive-coating means consist, for example, of "guns" able accurately to spray heated adhesive onto a given adhesive-coating region of each flap.

FIGS. 5*c* to 5*f* use arrows drawn in dotted line to illustrate the movements involved in bending up the various flaps 5 to 9 during the boxing cycle.

As a preference, the flaps 6 are positioned more or less horizontally at the station A then held in this position as far as the station B, while the flaps 5 and 7 are, respectively, during the transfer between A and B and/or at the station B, folded toward the inside of the box 12A, 12B so that they become positioned laterally, that is to say at right angles to the transverse faces 1, 3 and to the bottom 2.

The machine 10 also comprises a loading device (not depicted) for picking up and transferring products 28, generally formed into batches, as illustrated by an arrow F in FIG. 5*d* of the filling station B.

In the known way, the operation of filling the made-up box 12A with the products 28 may be performed either laterally through an open one of the lateral faces of the box 12B, or vertically downward so as to deposit the products 28 on the horizontal bottom 2 of the box 12B made up earlier at the station A.

Numerous loading devices for boxing the products 28 laterally or vertically, such as automated arms comprising gripper means for picking up a batch of products are known.

The gripper means (not depicted) are in particular dependent on the packaging and the type of product to be transferred into the box, and so these means may be of a mechanical type, for example a gripper, or alternatively may be of a pneumatic type, such as suction cups.

When the box is filled vertically, each pair of flaps 5 and 7 is then advantageously held in said lateral position so that adhesive can be applied to it and to allow each of the flaps 5 and 7 to be adhesively bonded to the corresponding flap 6 when the filled box 12B is transferred to the third, sealing, station C.

To do this, each flap 6 is bent and folded vertically upward, then advantageously pressed against the flaps 5 and 7 for a determined period of time that is long enough to guarantee a secure assembly. The other two faces, that is to say the lateral faces, of the box 12 are thus partially formed.

As can be seen by comparing FIGS. 5*e* and 5*f*, the lid 4 is then bent and folded downward until it runs parallel to the horizontal bottom 2 using bending/folding means (not depicted) with which the sealing station C is equipped.

In the same way, the flaps 8 are bent and folded against the flaps 5 and 7, already coated with adhesive, to finish forming the lateral faces of the box 12 and the flap 9 is bent and folded against the external face, already coated with adhesive, of the transverse face 1 to complete the sealing of the filled box 12B.

As an alternative, the flap 9 is coated with adhesive by adhesive-coating means which move as one with the gripper means of the loading/filling device which, for example, having picked up the products 28 effects a transverse first movement to position itself over the box 12B then a vertical second movement to deposit the products 28.

In the known way, the sealing station C advantageously comprises pressing and/or squaring means (not depicted) to check that the box has been made up into a parallelepiped and to exert pressing force on the various adhesive-coated parts, such as the flaps, to ensure that they are securely fastened.

An exemplary embodiment of the conveying device 30 according to the invention, depicted in detail in FIGS. 6 to 8, will be described hereinafter.

According to the invention, the conveyor device 30 comprises a carriage 32 which is mounted to be able to move longitudinally, in both directions, and back and forth, between an extreme upstream position and an extreme downstream position, and which bears box transfer means 34 here comprising a first gripper 36 for transferring a made-up box 12A from the first station A to the second station B and a second gripper 38 for simultaneously transferring another, filled, box 12B from the second station B to the third station C.

Advantageously, each of the first and second grippers 36, 38 comprises at least an upstream restraining means 40 and a downstream restraining means 42 of the box 12.

The upstream 40 and downstream 42 restraining means are mounted such that they can move between:

an active position in which the restraining means 40, 42 collaborate with part of the corresponding box 12A, 12B in order simultaneously to transfer each box 12A, 12B from one given station to the next station, and an inactive position in which, having transferred said boxes 12A, 12B, the restraining means 40, 42 are retracted so as to allow the carriage 32 to reposition itself in its upstream initial position, in a return path.

Figure 6:
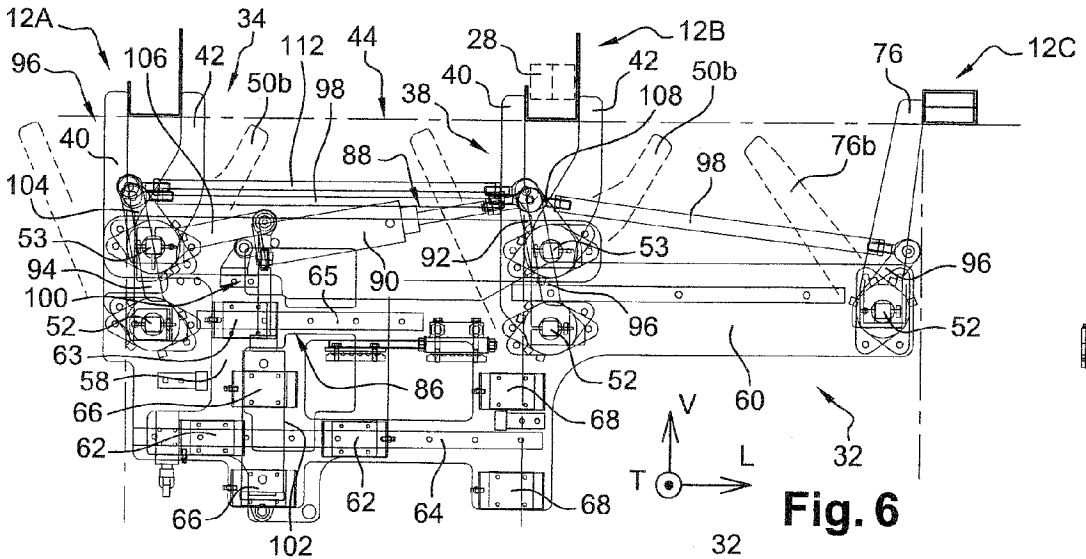

When the carriage 32 is in the extreme upstream position, the box blank 14 which has been made up into a box constitutes the made-up box 12A depicted at station A in FIGS. 1 and 6.

What actually happens, as explained before, is that the box blank 14 is taken by the transfer arm 20 to be made up through the combined action of the guide means 24, 26 and of the arm 20, the position of the box 12A as illustrated in FIG. 5*c* being obtained when the transfer arm 20 reaches its lowered, making-up, position with the bottom 2 horizontal.

The made-up box 12A is then held in this position by the restraining means 40, 42 of the grippers 36, 38 which are in the active position.

More specifically, in the active position, the restraining means 40, 42 of each gripper 36, 38 collaborate with a part of the upstream 1 and downstream 3 transverse faces which are adjacent to the horizontal bottom 2 of the box 12 such that, between two successive stations, the bottom 2 of each box slides along a horizontal guide path 44.

Advantageously, the downstream guide means for guiding the box blank 14, which consist of the rods 26, are mounted such that they can move vertically between a lowered retaining position in which the rods hold the lid 4 of the box 12 in position at the station A, and a raised release position into which the rods 26 are moved upward so that they do not impede the transfer of the box 12A from the station A to the station B by the first gripper 36 of the conveying device 30.

The guide path 44 runs longitudinally along the packaging line 16 of the machine, that is to say from the upstream end downstream and adjacent to the stations A, B and C which are positioned laterally, here on the left-hand side, with respect to the guide path 44 and therefore with respect to the packaging line 16.

As a preference, the guide path 44 consists of the upper horizontal bearing face 46 of two longitudinal rails 48 which, being parallel, longitudinally and transversely delimit the packaging line 16.

The restraining means 40, 42 of the first and second grippers 36, 38 of the carriage 32 are arranged transversely between the two rails 48 and are thus moved longitudinally along the packaging line 16 by the carriage 32, back and forth between an extreme upstream position and an extreme downstream position, in an outward path and a return path.

The restraining means 40, 42 of each gripper 36, 38 are mounted such that they can pivot about transverse axes orthogonal to the longitudinal rails 48 between the active position in which the upstream 40 and downstream 42 restraining means extend vertically above the upper horizontal bearing faces 46 of the rails 48 so as to collaborate with each box 12A and 12B and the inactive position in which the upstream 40 and downstream 42 restraining means are retracted below the upper horizontal bearing faces 46 of the rails 48 during the return path of the carriage 32 so as not to interfere with the bottoms 2 of the boxes 12A and 12B.

FIG. 6 depicts the active and inactive positions of the restraining means 40, 42 of each of the grippers 36, 38, these positions being depicted in solid line and in dotted line, respectively.

As a preference, each restraining means 40, 42 comprises a pair of arms 50, these being a left-hand arm 50*a* and a right-hand arm 50*b*, respectively, which means that each gripper 36, 38 is made up of four arms 50.

Advantageously, at least one, 50*b*, of the arms 50 of each restraining means 40, 42 is mounted such that it can move transversely with respect to support tubes 52, 53 that constitute the transverse axis of pivoting of the arms so as to allow the transverse separation between each of the arms 50*a*, 50*b* to be adjusted to suit the dimensions of the box 12, particularly the depth P of its bottom 2.

More specifically, the arms 50*a*, 50*b* of the upstream restraining means 40 of each of the grippers 36, 38 are mounted on lower transverse tubes 52 and the arms 50*a*, 50*b* of the downstream restraining means 42 of each of the grippers 36, 38 are mounted on upper transverse tubes 53, the tubes of axis 52, 53 being vertically offset and, on the whole, superposed.

The arms 50*a*, 50*b* of each restraining means 40, 42 of each gripper 36, 38 can be moved so that their transverse separation can be adjusted, particularly to suit the depth P.

Advantageously, the arms 50*a*, 50*b* are immobilized in the operating position by clamping means 54 which preferably allow the arms 50 to be clamped manually in a quick and simple way.

The clamping means 54 for clamping the arms 50 on the tubes of axis 52, 53 here are systems involving catches or self-locking screws, for example quarter-turn features, comprising a handle 56 and allowing adjustments to be made without recourse to any special purpose tooling whatsoever.

In a known way, such clamping means 54 are, for example, operated by hand using the handle 56 which, in order to unlock the system, is pulled against the action of a return spring that tends to return the system to the locked position and, for adjustment, is subjected to one or more rotational movements.

Figure 8:
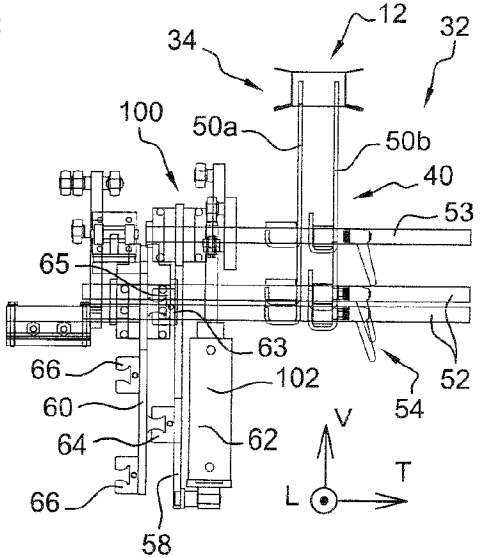
FIGS. 6 to 8 respectively depict a side view, a view from above and a detailed end-on view of the carriage of the conveying device comprising the grippers for the simultaneous transfer of boxes and the discharge arms.
Figure 7:
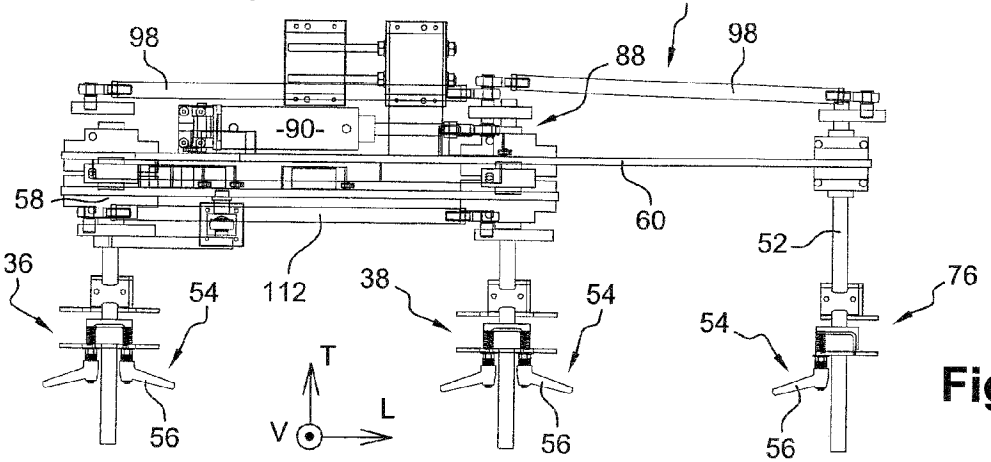

As can best be seen in FIGS. 6 to 8, the carriage 32 comprises a vertical first flange 58 and a vertical second flange 60, these respectively supporting the upstream restraining means 40 and the downstream restraining means 42 of the grippers 36, 38.

More specifically, the lower tubes of axis 52 bearing the pairs of arms 50*a*, 50*b*, upstream restraining means 40 are secured at one of their ends to the first flange 58 and the upper tubes of axis 53 bearing the pairs of arms 50*a*, 50*b*, downstream restraining means 42 are secured at one of their ends to the second flange 60.

The first and second flanges 58, 60 of the carriage 32 are mounted such that they can move one relative to the other in the longitudinal direction so as to allow the longitudinal distance between the upstream and downstream restraining means 40, 42 to be adjusted to suit the dimensions of the cardboard box, particularly the length L of its bottom 2.

The first flange 58 comprises, on its left-hand lateral face, two, upstream and downstream, lower wheels or shoes 62 forming a slideway and an upper shoe 63, which slide along a longitudinal lower rail 64 and an upper rail 65 respectively, these being secured to the right-hand lateral face of the second flange 60.

The second flange 60 comprises, on its left-hand lateral face, a pair of upstream shoes 66 and a pair of downstream shoes 68, each pair of shoes 66, 68 respectively comprising an upper shoe and a lower shoe, which are, on the whole, vertically aligned.

The pairs of shoes 66, 68 are mounted on a longitudinal lower rail 70 and a longitudinal upper rail 72, which are here secured to a frame part 74 of the machine 10 so as to allow the carriage 32 to slide between its upstream and downstream extreme positions.

The conveying device 30 according to the invention also comprises discharge means 76 for discharging the sealed box 12C from the sealing station C of the machine 10.

The discharge means 76 consist of a third pair of upstream discharge arms, these being a left-hand arm 76*a* and a right-hand arm 76*b* which are similar to the arms 50*a*, 50*b* of the upstream restraining means 40 of the grippers 36, 38.

The first flange 58 comprises, apart from the upstream restraining means 40 of each of the grippers 36, 38, the discharge arms 76*a*, 76*b* which are positioned at its downstream end in such a way as to face the sealing station C when the carriage 32 is in the extreme upstream position.

Advantageously, the discharge arms 76 are mounted such that they can move in a way that is synchronized with the movement of the upstream restraining means 40.

Likewise, the discharge arms 76*a*, 76*b* are mounted such that they can move between an active position in which they collaborate with the upstream transverse face 1 of the box 12C and an inactive position in which the arms 76 are retracted, like the arms 50 of the grippers 36, 38, so as to allow the carriage 32 to reposition itself, in a return path.

The discharge arms 76 therefore have the function, during the outbound path of the carriage 32, of pushing the sealed box 12C in the downstream direction to cause it to slide along the upper horizontal bearing face 46 of the rails 48 that form the guide path 44, from the sealing station C out of the machine 10, where the box 12C is, for example, conveyed, either automatically or otherwise, by transport means (not depicted) as far as a dispatch area.

The discharge arms 76 therefore also constitute transfer means 36 within the meaning of the present invention.

In a similar way to the arms 50, the discharge arms 76 are mounted such that they can pivot about a transverse axis 52 orthogonal to the longitudinal rails 48 respectively between the active position in which the arms 76 extend vertically above the upper horizontal faces 46 of the rails 48 to collaborate with the box 12C and the inactive position in which the arms 76 are retracted below the upper horizontal face 46 of the rails 48 during the return path of the carriage 32.

Advantageously, at least one, 76*b*, of the discharge arms 76 is able to move transversely in such a way as to allow the transverse separation of the arms 76 to be adjusted to suit the dimensions of the cardboard box, particularly the width P of the box 12, here of its bottom 2.

The dynamics of the operation of the conveying device 30 according to the invention during the boxing cycle illustrated in FIGS. 5*a* to 5*f* will be described hereinbelow.

When the carriage 32 is initially in the extreme upstream position, the first gripper 36 is arranged longitudinally at the making-up station A while the second gripper 38 faces the filling station B and the discharge arms 76 for discharging the box face the sealing station C.

The gripper 36 is then in the active position in which the arms 50*a*, 50*b* of its upstream 40 and downstream 42 restraining means collaborate with the made-up box 12A located at the station A, and likewise, those of the gripper 38 collaborate with the filled box 12B located at the station B and finally the discharge arms 76*a*, 76*b* collaborate with the sealed box 12C located at the station C.

The carriage 32 is moved longitudinally between its extreme upstream position and its extreme downstream position and vice versa, by a drive device 78 that the machine 10 comprises.

The drive device 78 comprises, for example, belt-driven transmission means 80 which are driven by a servomotor 82.

The carriage 32 therefore performs a first longitudinal journey from its extreme upstream position to its extreme downstream position which corresponds to the outbound path during which the first gripper 36 transfers the made-up box 12A from the station A to the station B, the second gripper 38 transfers the filled box 12B from the station B to the station C and the discharge arms 76*a*, 76*b* push the sealed box 12C downstream out of the machine 10.

In order to allow a given box to be held temporarily in a longitudinal position, particularly when some of the restraining 40, 42 or discharge 76 means are retracted in their inactive position during the second journey, in the opposite direction, during which the carriage 32 repositions itself in the extreme upstream position, the machine 10, at some of the stations, comprises immobilizing means 84 which will be described in greater detail later on.

The conveying device 30 comprises actuating means 86 for switching the transfer means 34 which consist of the grippers 36, 38 and the discharge arms 76 between their active and inactive positions.

As a preference, the actuating means 86 comprise first means 88 for actuating the upstream restraining means 40 and the discharge arms 76*a*, 76*b* which are borne by the first flange 58.

The first means 88 comprise at least one actuating cylinder 90 which acts on a first main control lever 92, secured to one of the lower tubes 52, and causes the assembly comprising the tube of axis 52 and the—arm 50*a*, 50*b* (that is to say the upstream restraining means 40), in this instance those of the second gripper 38, to rotate between the active and inactive positions.

The first main control lever 92 moves as one with similar levers 94 and 96 respectively controlling the upstream restraining means 40 of the first gripper 36 and the discharge arms 76 as a result of connecting rod linkages 98.

In the same way, the actuating means 86 also comprise second means 100 for actuating the downstream restraining means 42 which are borne by the second flange 60.

The second means 100 comprise at least one actuating cylinder 102 which acts on a second main control lever 104 via a connecting rod 106, secured to one of the upper axis tubes 53 bearing the arms 50*a*, 50*b* of the downstream restraining means 42 of the first gripper 36, causing them to rotate between the active and inactive positions.

The second main control lever 104 moves as one with the lever 108 which respectively controls the upstream restraining means 40 of the second gripper 38 via a connecting rod linkage 112.

Advantageously, the connecting rod linkages 98 and 112 constitute means for synchronizing the reciprocating back and forth movements of the restraining means 40, 42 of the grippers 36, 38 and of the discharge arms 76 between the active and inactive positions.

Thus, when the carriage 32 is in its extreme downstream position, the actuating means 86 are then operated in such a way as to cause the arms of the grippers 36, 38 and the discharge arms 76 to pivot into the inactive position.

The station A is then empty because the made-up box 12A has been transferred to the station B by the gripper 36, and so here the making-up station A does not therefore have any means 84 of immobilizing a box.

What happens is that the new box blank 14 brought in by the transfer arm 20 is immobilized longitudinally upstream by the bows 24 and downstream by the rods 26 until such time as the arms of the first gripper 36, when the carriage 32 is in its extreme upstream position, return to the active position.

However, at station B, this made-up box 12A destined for filling has, by contrast, to be held in position, especially longitudinally and at least while the restraining means 40, 42 of the second gripper 38 are in the inactive position.

This is why the filling station B comprises, upstream and downstream, immobilizing means 84 which temporarily take over the role of the restraining means 40, 42.

The sealing station C also comprises similar immobilizing means 84 which are arranged only downstream and which constitute temporary stop means ensuring that the filled box 12B is correctly longitudinally positioned while upstream, means known as box-squaring means (not depicted), and which are, for example, arranged vertically above the station C, act upon this box.

Thanks to the immobilizing means 84, the carriage 32 performs its return path to reposition itself in the extreme upstream position and then the arms of the grippers 36, 38 and the arms 76 are actuated in such a way as to pivot into their active positions so as to return to the initial configuration illustrated in FIGS. 1 and 6.

One complete boxing cycle thus corresponds to an outward path and then a return path of the carriage 32 comprising the transfer means 34.

The immobilizing means 84 here consist of upstream 114 and/or downstream 116 fingers which are preferably arranged and mounted such that they can move in each of the longitudinal rails 48.

The pairs of upstream 114 and/or downstream 116 fingers are mounted such that they can move between:

- a work position in which the fingers 114, 116 project above the plane of the upper horizontal face 46 of the rails 48 so as to immobilize at least one of the boxes 12B, 12C at the corresponding station, and
- a position of rest in which the fingers 114, 116 are retracted below the upper horizontal face 46 so as not to interfere with the box 12B or 12C while it is being transferred to the next station or discharged from the machine.

More specifically, each upstream 114 and downstream 116 finger is mounted, at its lower end, such that it can pivot about a transverse axis and is moved between its work position and position of rest by actuating means 118 here comprising an actuating cylinder 120 the rod of which acts on a lever 122 causing the finger 114, 116 to pivot.

Advantageously, the downstream finger 116 of the stations B and C and its actuating means 118 are mounted secured to a support plate 124 to form an individual subassembly that is mounted such that it can move longitudinally, in this instance by sliding in the rail 48 so that the longitudinal distance between the pairs of upstream fingers 114 or the means for squaring the box 12C and the pairs of downstream fingers 116 can be adjusted to suit different formats of box 12, particularly different lengths L.

For ease of understanding, in FIG. 1 at the stations B and C there is depicted just one such subassembly with the downstream finger 116 of station B deliberately longitudinally offset into an extreme upstream position corresponding to the longest length L of box 12 that can be processed in the machine 10.

In FIG. 1, in the case of the downstream finger 116 of the station B, the two positions for the finger 116 that longitudinally immobilizes the boxes have been depicted, these being the working position in which the finger projects from the rail 48, shown in dotted line, and the position of rest in which the finger is retracted inside the rail 48, shown in solid line.

Advantageously, the machine 10 comprises other immobilizing means, particularly pneumatic means, such as suction cups, associated with a suction device allowing part of a box, such as the bottom or one of its flaps, to be held or immobilized for example.

The machine 10 comprises, in this instance at the filling station B, a suction cup 126 which is arranged within the thickness of the right-hand rail 48 and flush with the upper horizontal bearing surface 44 of the guide path 44 so as to apply a downward vertical suction force to one of the flaps 6 of the box 12 in order to keep it in a substantially horizontal position.

Advantageously, the machine 10 comprises adjusting means 128 for altering the transverse spacing between each longitudinal rail 48 that forms the guide path 44 along which the bottoms 2 of the boxes slide so as to allow modifications to be made quickly and simply to suit the various formats of box 12, just as can be done for the transfer means 34 of the conveying device 30.

The adjusting means 128 here comprise an operating handwheel or crank 130 which turns a transmission chain 132 actuating a transverse shaft 134 acting, via screw-nut type connecting means, on the position of the rails 48.

Advantageously, the transverse separation of the means borne by the rails 48, such as the immobilizing means 84, 114, 116 are also adjusted simultaneously.

As can best be seen in FIG. 3, the carriage 32 is arranged in the machine 10 transversely on the outside of the packaging line 16, here offset laterally to the left, so as to free up space 136 situated vertically below the packaging line 16 so as to facilitate access, particularly from the right, to this area of the machine 10.

Advantageously, access can thus be had easily to the clamping means 54 which allow the transverse separation of the arms 50*a*, 50*b* of the grippers 36, 38 or the discharge arms 76*a*, 76*b* to be adjusted.

What is more, the conveying device 30 according to the invention, arranged like this in the machine 10, is less sensitive to dirt than dogchain conveying devices of the prior art.

This is because any dust and/or fine particles of cardboard originating from the box blanks, particularly during the making-up operation are a permanent source of soiling of the conveyor device liable to cause operational down-time and, at the very least, demanding regular maintenance and cleaning operations.

In addition, when the machine is running, chain-conveyor devices are also directly exposed to dirt or soiling from the actual contents of a product being packaged, which in particular has a tendency to spread over the chains, and particularly to infiltrate between the links.

This would, for example, be what would happen if a bottle of shampoo was imperfectly sealed as a result of being knocked or as a result of an incident during the operation of automatically loading/filling the box when a product that had become loose broke open and sprayed its contents over the packaging line of the machine.

It will be appreciated that such down-time or operations are particularly expensive, as are any stoppages for adjusting the machine 10 to suit a different box.

As a preference, drive means (not depicted) for driving the transfer arm 20 are arranged in the machine 10 upstream of the storage magazine 18 or upstream of the first station A, so as also to protect these drive means from said soiling originating from dust and/or fine particles of cardboard and leave the space 136 under the packaging line 16 clear.

Advantageously, a particular arrangement of the carriage 32 such as this and, in general, of the other facilities of the machine 10 therefore makes a large contribution towards making access to this space 136 easier, especially for adjusting the transfer means or alternatively for performing maintenance and cleaning operations which do not necessarily involve having to shut the machine 10 down.

Of course, the exemplary embodiment described above for a machine 10 of the "overwrapping" type (using a wrap box) is entirely nonlimiting.

As an alternative, the conveying device according to the invention is used in a boxing machine of the type employing American boxes.

The invention claimed is:

1. A machine for packaging a product or products into a cardboard box in a boxing cycle comprising at least three successive operations for making up, filling and sealing the box, the machine comprising:

boxing means which are arranged along a longitudinal packaging line of the machine comprising, from an upstream end to downstream, a first, making-up, station which receives a succession, at a given rate, of box blanks intended to be at least partially made up and comprising a conveyor device for successively transferring in a downstream direction in an outbound path the box which has thus been made up toward a second, filling, station at which the products are packed into the box by associated loading means able to deposit the products that are to be packaged in the box, and then on to a third, box-sealing, station at which the box is sealed before it is discharged from the machine, wherein the conveyor device comprises a carriage which is mounted to be able to move longitudinally, in both an upstream direction and the downstream direction, and back and forth between an extreme upstream position and an extreme downstream position, and which bears box transfer means comprising at least a first gripper for transferring a made-up box from the first station to the second station and a second gripper for simultaneously transferring another, filled, box from the second station to the third station.

2. The machine as claimed in claim 1, wherein each of the grippers comprises an upstream restraining means and a downstream restraining means which are mounted such that they can move between:

an active position in which the upstream and downstream restraining means collaborate with part of the corresponding box in order simultaneously to transfer each box from one given station to the next station, and an inactive position in which, having transferred said boxes, the upstream and downstream restraining means are retracted so as to allow the carriage to reposition itself in its upstream initial position, in a return path.

3. The machine as claimed in claim 2, characterized in that wherein the conveying device comprises discharge means for discharging the sealed box from the third station of the machine, which discharge means are mounted such that they can move between an active position and an inactive position in a way that is synchronized with the movement of the upstream restraining means.

4. The machine as claimed in claim 2, wherein, in the active position, the upstream and downstream restraining means of each gripper or discharge means collaborate with at least part of transverse faces of the box which are adjacent to a horizontal bottom of the box such that, between two successive stations, the bottom of each box slides along a guide path.

5. The machine as claimed in claim 4, wherein the guide path consists of the upper horizontal bearing face of two longitudinal rails of the packaging line between which the up stream and downstream restraining means of the first and second grippers and/or the discharge means are positioned.

6. The machine as claimed in claim 5, wherein the upstream and downstream restraining means of each gripper and/or the discharge means are mounted such that they can pivot about a transverse axis orthogonal to the longitudinal rails respectively between the active position in which the upstream and downstream restraining means and/or the discharge means extend vertically above the upper horizontal faces of the rails so as to collaborate with the box, and the inactive position in which the upstream and downstream restraining means and/or the discharge means are retracted below the upper horizontal face of the rails during the return path of the carriage.

7. The machine as claimed in claim 6, wherein the machine further comprises immobilizing means capable of temporarily holding each box in a longitudinal position at a given station when the upstream and downstream restraining means and/or the discharge means are retracted into their inactive position.

8. The machine as claimed in claim 7, wherein the temporary-immobilizing means consist of fingers which, arranged in each of the longitudinal rails, are mounted such that they can move between a working position in which the fingers project above the plane of the upper horizontal face of the rails so as to immobilize the box and a position of rest in which the fingers are retracted below the upper horizontal face so as not to interfere with the box while it is being transferred to the next station.

9. The machine as claimed in claim 2, wherein the carriage comprises a vertical first flange supporting the upstream restraining means and/or the discharge means, and a vertical second flange supporting the downstream restraining means, and wherein the first and second flanges are mounted such that they can move one relative to the other in the longitudinal direction so as to allow the longitudinal distance between the upstream and downstream restraining means and/or between the discharge means and an immobilizing means that temporarily holds each box to be adjusted to suit the dimensions of the cardboard box.

10. The machine as claimed in claim 2, wherein each of the upstream and downstream restraining means of a gripper and/or the discharge means consists of a pair of arms of which at least one is mounted such that it can move transversely so as to allow the transverse separation between each of the arms to be adjusted to suit the dimensions of the cardboard box.

11. The machine as claimed in claim 2, wherein the carriage is arranged transversely on the outside of the packaging line so as to free up the space situated vertically under the packaging line to facilitate access to this part of the machine, particularly with a view to adjusting the transfer means such as the grippers or performing maintenance or cleaning operations.

12. The machine as claimed in claim 3, wherein, in the active position, the upstream and downstream restraining means of each gripper or discharge means collaborate with at least part of transverse faces of the box which are adjacent to a horizontal bottom of the box such that, between two successive stations, the bottom of each box slides along a guide path.

13. The machine as claimed in claim 3, wherein the carriage comprises a vertical first flange supporting the upstream restraining means and/or the discharge means, and a vertical second flange supporting the downstream restraining means, and in that the first and second flanges are mounted such that they can move one relative to the other in the longitudinal direction so as to allow the longitudinal distance between the upstream and downstream restraining means and/or between the discharge means and the immobilizing means to be adjusted to suit the dimensions of the cardboard box.

14. The machine as claimed in claim 4, wherein the carriage comprises a vertical first flange supporting the upstream restraining means and/or the discharge means, and a vertical second flange supporting the downstream restraining means, and in that the first and second flanges are mounted such that they can move one relative to the other in the longitudinal direction so as to allow the longitudinal distance between the upstream and downstream restraining means and/or between the discharge means and the immobilizing means to be adjusted to suit the dimensions of the cardboard box.

15. The machine as claimed in claim 5, wherein the carriage comprises a vertical first flange supporting the upstream restraining means and/or the discharge means, and a vertical second flange supporting the downstream restraining means, and in that the first and second flanges are mounted such that they can move one relative to the other in the longitudinal direction so as to allow the longitudinal distance between the upstream and downstream restraining means and/or between the discharge means and the immobilizing means to be adjusted to suit the dimensions of the cardboard box.

16. The machine as claimed in claim 6, the carriage comprises a vertical first flange supporting the upstream restraining means and/or the discharge means, and a vertical second flange supporting the downstream restraining means, and in that the first and second flanges are mounted such that they can move one relative to the other in the longitudinal direction so as to allow the longitudinal distance between the upstream and downstream restraining means and/or between the discharge means and the immobilizing means to be adjusted to suit the dimensions of the cardboard box.

17. The machine as claimed in claim 3, wherein each upstream and downstream restraining means of a gripper and/or the discharge means consists of a pair of arms of which at least one is mounted such that it can move transversely so as to allow the transverse separation between each of the arms to be adjusted to suit the dimensions of the cardboard box.

18. The machine as claimed in claim 4, wherein each upstream and downstream restraining means of a gripper and/or the discharge means consists of a pair of arms of which at least one is mounted such that it can move transversely so as to allow the transverse separation between each of the arms to be adjusted to suit the dimensions of the cardboard box.

19. The machine as claimed in claim 5, wherein each upstream and downstream restraining means of a gripper and/or the discharge means consists of a pair of arms of which at least one is mounted such that it can move transversely so as to allow the transverse separation between each of the arms to be adjusted to suit the dimensions of the cardboard box.

20. The machine as claimed in claim 6, wherein each upstream and downstream restraining means of a gripper and/or the discharge means consists of a pair of arms of which at least one is mounted such that it can move transversely so as to allow the transverse separation between each of the arms to be adjusted to suit the dimensions of the cardboard box.

21. A machine for packaging a product into a cardboard box as part of a boxing cycle, said boxing cycle comprising at least three successive operations for making up, filling and sealing the box, the machine comprising along a longitudinal packaging line of the machine from an upstream end to a downstream end:

- a first, making-up, station which receives a succession, at a given rate, of box blanks intended to be at least partially made up and comprising a conveyor device;
- a second, filling, station at which the product is packed into the box by associated loading means able to deposit the product that is to be packaged in the box, said conveyor device successively transferring in a downstream direction in an outbound path the box which has thus been made up toward said second station; and
- a third, box-sealing, station at which the box is sealed before the box is discharged from the machine, wherein the conveyor device comprises a carriage which is configured to move longitudinally in reciprocating back and forth movements corresponding to said outbound path and a return path, between an extreme upstream position and an extreme downstream position, said conveyor device including box transfer means comprising at least a first gripper for transferring a made-up box from the first station to the second station and a second gripper for simultaneously transferring another, filled, box from the second station to the third station.

* * * * *